United States Patent [19]

Good et al.

[11] Patent Number: 4,784,760

[45] Date of Patent: Nov. 15, 1988

[54] MAGNETIC SEPARATORS

[75] Inventors: Jeremy A. Good, London, England; Etienne H. Roux, Orwa, South Africa

[73] Assignees: Cryogenic Consultants Limited, London, England; Foskem (Proprietory) Limited, Phalaborwa, South Africa

[21] Appl. No.: 45,177

[22] Filed: Apr. 22, 1987

Related U.S. Application Data

[63] Continuation of Ser. No. 712,470, Mar. 15, 1985, abandoned, which is a continuation of Ser. No. 395,225, Jul. 6, 1982, abandoned.

[30] Foreign Application Priority Data

Jul. 6, 1981 [GB] United Kingdom ..... 8210865

[51] Int. Cl.[4] ..... B07C 5/344

[52] U.S. Cl. ..... 209/223.1; 209/231

[58] Field of Search ..... 209/39, 40, 214, 225, 209/228, 231, 232, 138, 143, 213, 223.1, 641, 127.4, 636, 635, 631, 478, 211

[56] References Cited

U.S. PATENT DOCUMENTS

| | | | |
|---|---|---|---|
| 262,790 | 8/1882 | King | 209/223.1 |
| 466,514 | 1/1892 | Reed | 209/225 |
| 3,552,564 | 1/1971 | Burgener et al. | 209/214 |
| 3,887,456 | 6/1975 | Loughner | 209/211 |
| 4,042,492 | 8/1977 | Decker et al. | 209/223.1 |
| 4,153,558 | 5/1979 | Frykhult | 209/211 |
| 4,609,109 | 9/1986 | Good | 209/636 |

FOREIGN PATENT DOCUMENTS

| | | | |
|---|---|---|---|
| 127934 | 4/1932 | Fed. Rep. of Germany | 209/142 |
| 3046 | 2/1914 | United Kingdom | 209/223.1 |

*Primary Examiner*—Kenneth M. Schor

*Attorney, Agent, or Firm*—Wood, Herron & Evans

[57] ABSTRACT

Separation apparatus and method for separating relatively magnetic particles from a stream of particulate material made up of relatively magnetic and relatively non-magnetic particles. A mixture of the magnetic and non-magnetic particles flows in a three-dimensional stream in a common path closely adjacent to the wall of a channel. A magnet producing a strong magnetic field force is located adjacent the wall of the chamber to produce a strong horizontal magnetic force and a vertical force which is less than that of gravity. The free fall of the particles adjacent the channel wall is interrupted in the vicinity of the magnet to cause the particles to move away from the wall. Thereafter, the magnetic particles move back towards the magnet whereas the non-magnetic particles are not drawn away from their diverted path.

4 Claims, 2 Drawing Sheets

MAGNETIC SEPARATORS

BACKGROUND OF THE INVENTION

This application is a continuation of Ser. No. 712,470, filed Mar. 15, 1985, which in turn is a continuation of Ser. No. 395,225, filed July 6, 1982, both of which are abandoned.

This invention relates to a magnetic separator for minerals separation and to methods of minerals separation.

The invention is particularly concerned with a separation system in which the material to be separated is allowed to fall freely past a high strength magnet. The relatively magnetic material is attracted towards the magnet and the relatively non-magnetic material continues in a relatively straight path. Splitter members may be used to separate the two streams.

One problem which has been encountered is that if all the material falls in a path away from the magnet, it falls in a relatively low magnetic field resulting in the magnetic material which is attracted to the magnet reaching the high field region when it has already been separated from the non-magnetics. On the other hand, if the material all falls closely adjacent the magnet wall, then the non-magnetic material falls down with the magnetic material and there is not sufficient relative movement of the magnetic material to achieve separation.

A magnetic separator in accordance with this invention solves this problem by providing means at or closely adjacent the inner wall of the separation channel and extending down over at least a part of the portion of the separation channel which extends past the magnet to divert the particulate material to be separated substantially horizontally away from the magnet.

The diversion means may comprise a bump, hump or ridge, preferably having a smooth upper surface so as to avoid re-mixing of the material. A sharp step causes mineral to be bounced at random and this may cause a degradation in the quality of separation. Several bumps or humps may be provided one above the other.

Alternatively the diversion means may take the shape of a chute or "ski" ramp having a profile extending in the direction of free fall, outwardly from the magnet, followed by a necked portion.

The use of the particle diversion means enables the ore to be fed adjacent the inner wall of the separation channel i.e. that nearest the magnet and in the region of maximum field strength for the channel. Some separation takes place above the said diversion means, but this is limited. When the stream of particles is diverted by the said means, away from the magnet, the non-magnetic particles are thrown out well clear of the magnet and then continue to fall in their diverted path. The magnetic particles on the other hand are drawn back towards the magnet immediately after being diverted and thereafter follow the wall of the channel.

The two streams then pass on either side of an appropriately positioned splitter plate.

The magnet for the separator is preferably cryogenic and may have a circular coil or coils or may be the linear magnet described and claimed in co-pending application Ser. No. 395,224, now abandoned, filed simultaneously herewith.

Typically, the stream of ore is 3 to 6 mm in thickness and the ridge or bump 24 projects 4 to 10 mms from the surface of the wall. It is desirable that the shape is smooth on the upper side so as to avoid re-mixing of the mineral. A sharp step causes mineral to be bounced at random and this may cause a degradation in the quality of separation.

The materials are reseparated at each successive ridge or bump.

BRIEF DESCRIPTION OF THE DRAWINGS

The invention will now be further described by way of example with reference to the accompanying drawings in which.

DESCRIPTION OF THE PREFERRED EMBODIMENTS

Figure 1:
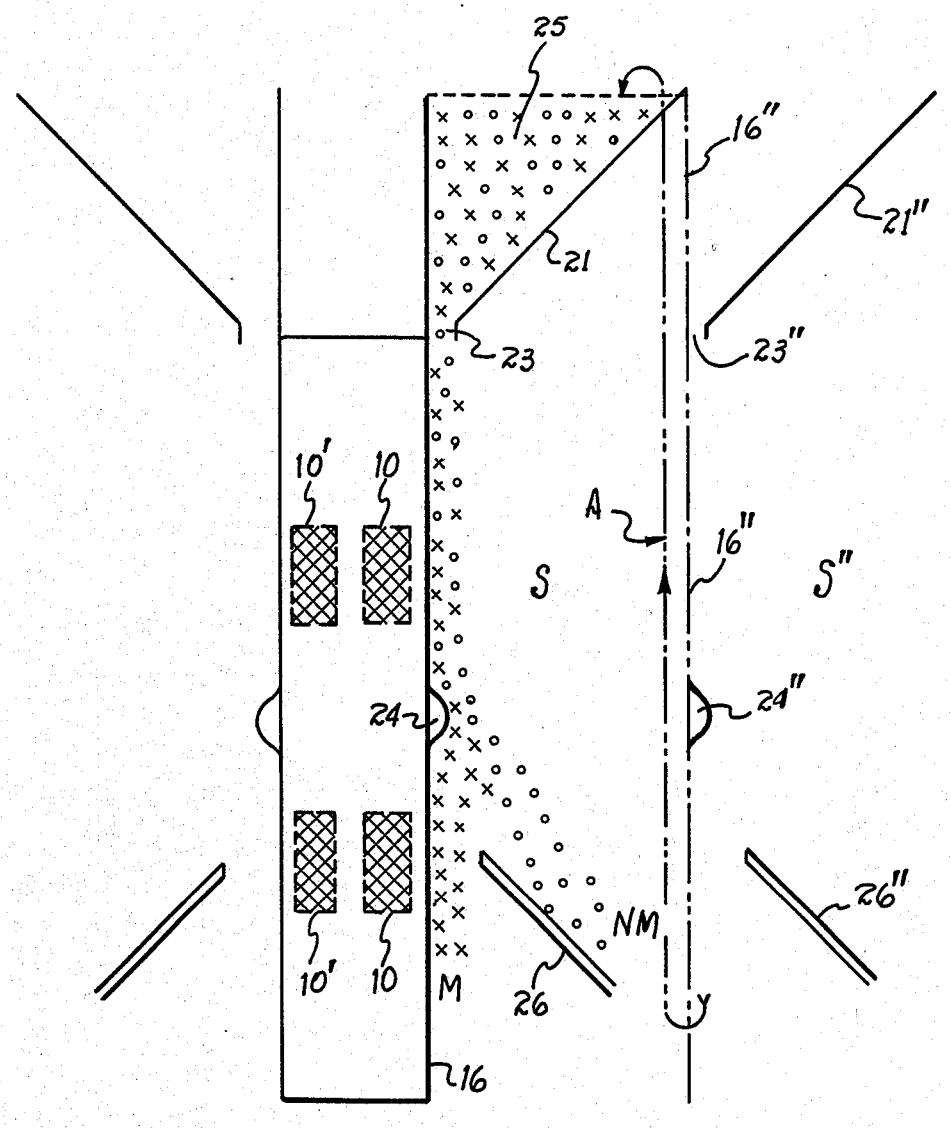
FIG. 1 is a part section through one embodiment of a magnetic separator in accordance with the invention showing one form of diversion means.

Referring to FIG. 1 of the drawings the separator comprises a linear dipole superconducting cryogenic magnet generally indicated at 10, 10' and a flat substantially rectangular cross section separation channel S formed between a wall 16 of the magnet and an outer wall (not shown).

The material to be separated is fed from a hopper 21 through an adjustable choke feed to fall adjacent the wall 16 of the magnet in a stream about 10 mm thick.

The magnetic force is adjusted, depending on the ore to be separated so that the ore 25 falls down the side of the magnet under the influence of gravity, the magnetic portion of the ore being drawn towards the magnet and held against the wall. This tends to reduce the falling velocity and increase the residence time for separation. A smooth bump 24 (or its equivalent) is provided on the wall 16 extending across the width of the channel wall, which causes the ore falling against or adjacent the wall and especially the non-magnetic fraction, to be diverted horizontally away from the wall to increase the physical dispersion of the magnetic and non-magnetic fractions.

Substantially non-magnetic mineral is diverted away from the magnetic mineral which tends to be reattracted by the magnet back towards the wall 16. Finally the relatively magnetic material falls adjacent the magnet and the relatively non-magnetic material away from the magnet, the two streams M and NM being separated by an adjustable flat splitter member 26 whose position can readily be adjusted toward or away from the flat wall 16.

To feed the mineral into the channel a simple linear choke feed 23 is required.

The feed channel can, if desired, be divided into a series of thin vertical channels, e.g. each 30 mms deep, each receiving a stream of crushed ore to be separated, instead of one broad channel, given that the magnetic field is of sufficient extent (say 100 mm) to encompass all the channels.

For example, if a second channel S" is used on both sides, this will be positioned outwardly of the channel S shown in FIG. 1, where the magnetic field is weaker. A first pass of the material may be made through this second channel S" and then a final or second pass through the first channel S adjacent the magnet where the field is stronger (see dashed arrow A in FIG. 1). The design and construction of the second channel S" is identical to that of the first channel S including the wall 16", hopper 21", feed 23", bump 24" and splitter 26" except in that the channel is further away from the magnet 10 and 10'.

As an example of the separation achieved tests were made on phosphate mineral containing about 14% apatite mineral and analysing as 5.8% $P_2O_5$. In a separation at a modest magnetic field of 24,000 gauss at a flow rate of 9 ton/hour per meter of magnet length ore was passed over the two bumps 24, 24" which protect 10 mm out from the walls 16, 16", respectively. The ore had a free wall of 100 mm from the linear hoppers 21, 21" during which fall it was held against the face of the channel adjacent to the magnet by the magnetic field. Below each bump the ore was split into magnetic and non-magnetic fractions. The magnetics from the first bump 24" were passed over the second bump 24, and two non-magnetic fractions being combined for treatment at a higher field. The splitters 26, 26" below each bump 24, 24" were positioned 30 mm away from the walls 16, 16" and 70 mm below the center of the bump. The non-magnetic product was 36% of the mass. Each magnetic product was discarded as waste mineral. The recovery of apatite was 77% in the non-magnetic product. This product was then retreated at a higher field of 31000 gauss.

Again the mineral was passed over the two bumps 24, 24" which project 10 mm from the walls 16, 16" after a 100 mm free fall. The splitters 26, 26" was set 20 mm from the walls 16, 16⊕, respectively and 70 mm below the bump. Each non-magnetic product from the first bump 24" analysed at 38.3% $P_2O_5$ or 90.3% phosphate. Magnetic measurement of the susceptability indicated 93% phosphate. The non-magnetic product from the second bump 24 represented 32.4% $P_2O_5$ or 76% apatite. The recovery of this second double stage of separation was 78%. The final product is of sufficient commercial grade.

Figure 2:
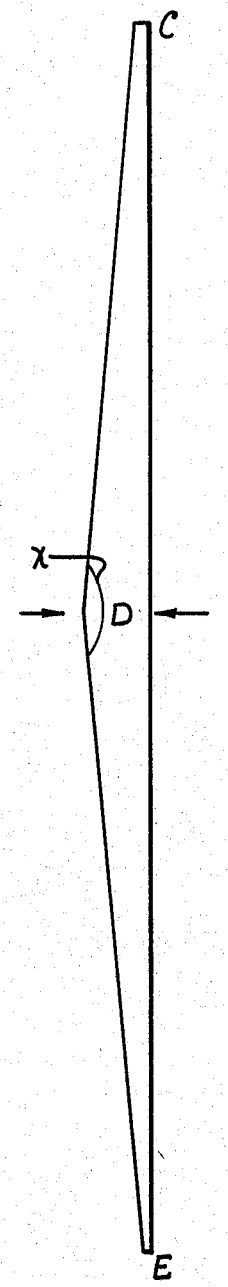
FIG. 2 is a diagram illustrating an alternative form of diversion means.
Figure 3:
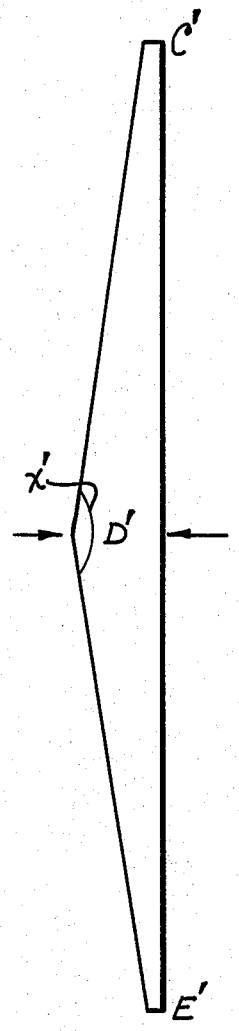
FIG. 3 is a diagram illustrating a further alternative form of diversion means.
Figure 4:
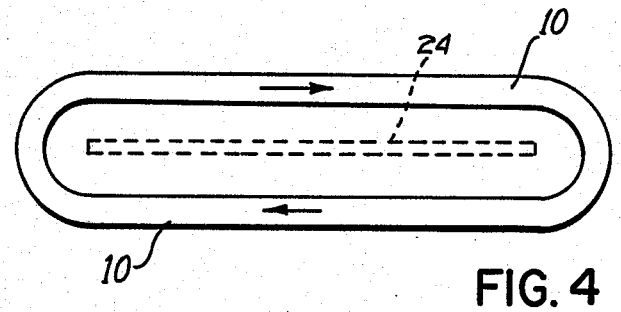

Referring to FIGS. 2 and 3, a "ski" ramp having a specific shape may be used instead of the rounded top humps or bumps to cause the particles to be thrown or moved out away from the magnet during their free fall path.

The dimensions of the two "ski" ramps shown in FIGS. 2 and 3, showing shapes "a" and "b", respectively, are as follows:

Shape No. a: Length CE 18.9 cm; depth D 1.25 cm; angle $x' = 168°$

Shape No. b: Length CE' 15.3 cm; depth D' 1.5 cm; angle $x = 161°$.

Shape No. b is mainly used for the first or cleaning pass whilst shape No. a is mainly used for the final separation step(s). The "ski" ramp shown in FIGS. 2 and 3 illustrate the actual dimensions of the "ski" ramps used.

Although the applicants are unable to state with accuracy what the maximum free-fall velocity is at which the "ski" ramps still operate effectively, it may be mentioned that the aforementioned tests were carried out under conditions where the ore fell for a distance of approximately 115 mm before it reached the separation point of the "ski" ramp. With the aid of a high-speed camera, it has been determined that the free-fall velocity of the particles is then 1.5 m/s. At this velocity acceptable metallurgical results were obtained. Poor metallurgical results were obtained when ore was allowed to free-fall for a distance of approximately 1000 mm, reaching a velocity of approximately 4.5 m/s. It is believed that even poorer metallurgical results would be obtained at velocities greater than 4.5 m/s.

What we claim is:

1. A magnetic separator, comprising:

means defining a particle separation channel having at least one substantially vertical wall and an inlet and an outlet;

a superconducting magnet located entirely outside said particle separation channel and positioned closely adjacent said vertical wall of said particle separation channel, said magnet producing a strong magnetic field force along said vertical wall which is of maximum intensity at a first area extending over only a portion of the length of said vertical wall said portion being intermediate the inlet and outlet of the channel;

feeder means, located above said first area, for feeding a particle stream containing relatively magnetic and relatively non-magnetic particles, said feeder means being located with respect to said channel such that it will direct said particle stream to said channel in free fall trajectory closely adjacent said vertical wall and such that said particle stream will fall vertically to bring said particles within the influence of said magnetic field of said magnet;

diversion means positioned within said channel at said first area and located relative to said vertical wall for deflecting both said relatively magnetic and relatively non-magnetic particles of said particle stream in a diverted path away from said vertical wall, such deflection providing a horizontal component to the trajectory of said particle stream;

a splitter plate having an upper end and opposed sides, said splitter plate being mounted within said particle separation channel to form both a first passageway defined between one side of said splitter plate and said vertical wall and a second passageway defined between the opposite side of said splitter plate and the remainder of said particle separation channel wall surface at the level of the splitter plate, said upper end of said splitter plate being positioned in said diverted path of magnetic and non-magnetic particles at said first area relative to said vertical wall but below said diversion means;

said separator being structured and designed such that said magnetic field force of maximum intensity acts upon said particle stream deflected in said diverted path at said first area to attract said magnetic particles inwardly toward said vertical wall and into said first passageway formed by said splitter plate, while said non-magnetic particles continue along said diverted path and fall by gravity into said second passageway formed by said splitter plate for separation from said magnetic particles.

2. A magnetic separator as claimed in claim 1 in which said diversion means comprises at least one bump or ridge extending across an inner wall of said channel.

3. A magnetic separator as claimed in claim 10 in which each said bump or ridge has an upper surface so constructed and arranged as to cause a gradual acceleration of horizontal velocity of said particles away from said magnet.

4. A magnetic separator as claimed in claim 1 in which said diversion means comprises an element presenting a sloped surface to the particle stream, the profile of which surface is constructed and arranged to extend, into the path of free fall, outwardly from said magnet.

* * * * *